United States Patent [19]

Miller

[11] 4,420,799

[45] Dec. 13, 1983

[54] CIRCULAR GAS DISCHARGE REFLECTOR LAMP

[76] Inventor: Jack V. Miller, 700 N. Auburn Ave., Sierra Madre, Calif. 91024

[21] Appl. No.: 409,999

[22] Filed: Aug. 20, 1982

[51] Int. Cl.[3] ..... F21S 5/00

[52] U.S. Cl. ..... 362/216; 362/263; 362/265; 362/307; 362/308; 362/309; 362/310; 362/375

[58] Field of Search ..... 362/216, 263, 265, 307, 362/308, 309, 310, 375

[56] References Cited

U.S. PATENT DOCUMENTS

| | | | |
|---|---|---|---|
| 1,935,729 | 11/1933 | Rosenbaum | 362/216 |
| 2,846,565 | 8/1958 | Binkley et al. | 362/216 |
| 3,986,017 | 10/1976 | Kulle | 362/216 |
| 4,244,013 | 1/1981 | Wotowiec | 362/216 |

*Primary Examiner*—Stephen J. Lechert, Jr.

[57] ABSTRACT

A circular gas discharge reflector lamp has a ballast supporting structure enclosing a ballast and having a male screw shell extending therefrom. Lamp engaging arms extend from the structure and hold a circular gas discharge lamp which is electrically connected to the ballast and screw shell in an operative circuit. A concave reflector partially enclosing the lamp and attached to the ballast supporting structure near the male screw shell. A lens attached at its perimeter to the perimeter of the reflector, which transmits the direct light emitted by the lamp and also transmits the reflected light from the reflector. The screw shell, ballast supporting structure, reflector and lens are joined together with continuously sealed seams whereby the reflector lamp is water tight.

8 Claims, 4 Drawing Figures

CIRCULAR GAS DISCHARGE REFLECTOR LAMP

BACKGROUND OF THE INVENTION

This invention relates to the type of reflector lamp commonly known as "PAR" lamps, an acronym for parabolic reflector lamps. These lamps are effective as spotlights or well controlled floodlights using simple parabolic reflectors behind an incandescent filament which is small enough to be treated as a point source. Such lamps as presently known are used in sockets and simple recessed fixtures, providing a relatively low cost installation, but with the known inefficiency of incandescent lamps, approximately 14 lumens per watt. It is known that circular gas discharge lamps may operate at luminous efficiencies of 40 to 50 lumens per watt with inductor ballasts, and up to 65 lumens per watt with inverter ballasts which operate the lamps at high frequencies. Circular fluorescent lamps are widely used in small lighting fixtures, and are also used in lampholder fittings such as those described in my U.S. Pat. Nos. 4,105,276 and 4,178,535. These lampholder fittings have bare, exposed lamps, and are usually designed for use within portable lamps fitted with lamp shades. Enclosing the lamp within a lampholder fitting has been unknown prior to this present invention, and my co-pending patent applications entitled "DECORATIVE GAS DISCHARGE LAMPHOLDER FITTING", and "LINEAR GAS DISCHARGE REFLECTOR LAMP".

These co-pending applications represent the first effective use of a gas discharge source, such as a fluorescent tube within a screw base supported lamp having any degree of optical control. The broad and diffuse nature of gas discharge sources, particularly circular sources, makes controlling the emitted light extremely difficult and requires careful design of both reflective and refractive elements in a common optical system. A simple paraboloidal reflector is inappropriate, as there is no luminous source at the focus. Also a conventional lenticular lens, commonly used in fresnel form to collimate small sources in such applications as automotive headlamps, relies on the existance of the luminous source at the lens focal point in order to function.

The principal purpose of this invention is to provide a reflector lamp employing a circular gas discharge lamp as a light source and having cooperating reflective and refractive optics to produce a relatively narrow light output beam. An additional co-pending patent application entitled "TRANSPARENT LIGHTING DIFFUSER FOR CIRCULAR GAS DISCHARGE LAMPS" describes one of the refractive techniques the inventor has found effective.

SUMMARY OF THE INVENTION

A circular gas discharge reflector lamp according to the invention has a ballast supporting structure holding a current limiting ballast and having proximal and distal ends. A tubular member extends from the proximal end of the ballast supporting structure and terminates in a male screw shell which is adapted to screw into a conventional light bulb socket. Arms extend from the ballast supporting structure and are provided with a means for securing a circular gas discharge lamp. A circular gas discharge lamp, such as a fluorescent lamp, is retained by the arms in an orientation that is generally coaxial with the central axis of the male screw shell with the plane of the circular lamp normal to the distal end of that axis. The lamp is so supported as to permit the emission of light, when energized, at least in the distal and proximal directions. The ballast, which includes a starting means, and the lamp and screw shell are interconnected with electrical conductors into an operative circuit to light the lamp with the screw shell electrically energized by installation into a conventional lamp socket. A concave reflector partially encloses the lamp on the proximal side, and is attached to the tubular extension of the ballast support structure. The reflector is a figure of revolution about the central axis, shaped to receive incident light from the lamp and reflect it generally into the distal direction. A transparent lens of circular shape completes the enclosure of the lamp and attaches at its perimeter to the circular perimeter of the reflector. The lens is provided with refractive elements that receive incident light from the lamp and refract it generally into the distal direction, and also receive incident light reflected from the reflector and refract it generally into the distal direction. The refractive elements of the lens have positive optical power, whereby off-axis incident rays tend to be refracted towards lines parallel to the normal axis of the lens.

The ballast support structure, the lamp retaining arms, and the tubular extension that holds the screw shell are a single, unitary plastic part molded of a self-extinguishing plastic suitable for holding electrical components. The reflector and lens may be made of other slow burning materials, such as polystyrene, acrylic or polycarbonate, which are available in transparent form. The lens, reflector, tubular extension and the screw shell are sealed at their respective interfaces in a preferred embodiment that is waterproof, and suited for outdoor use.

DETAILED DESCRIPTION OF THE DRAWINGS

Figure 1:
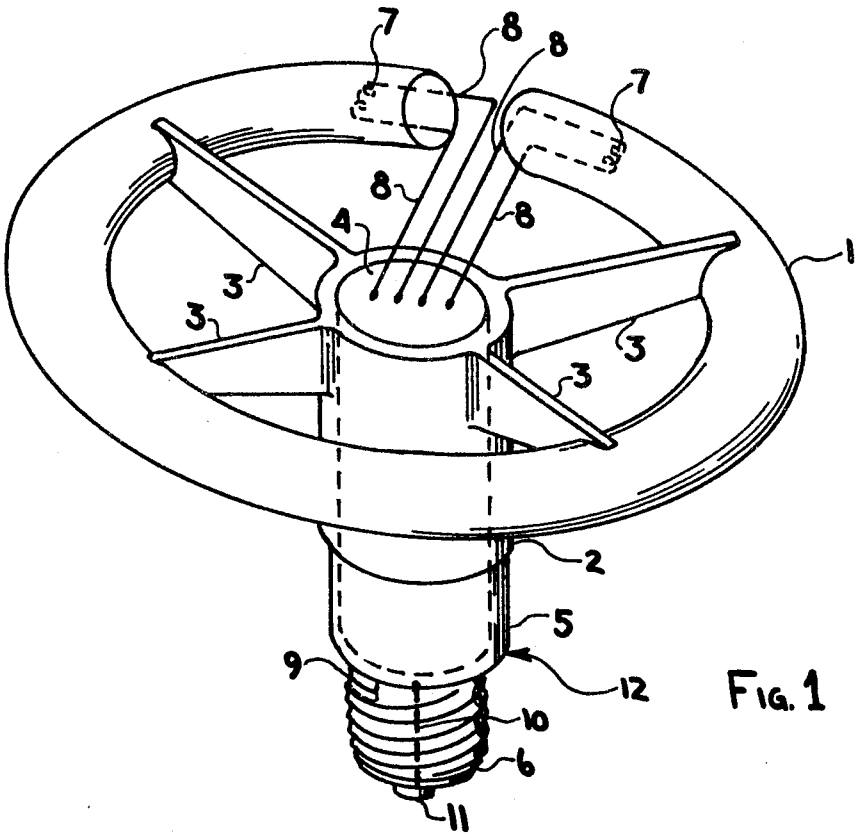
FIG. 1 is a perspective view of a ballast and lamp supporting structure according to the invention.

In FIG. 1 a circular gas discharge lamp 1 is shown supported generally at the distal end of a ballast housing 2 by a plurality of arms 3, said ballast housing 2 further supporting a ballast 4 and a tubular extension 5 depending in the proximal direction. Tubular extension 5 terminates in a male screw shell 6, which is adapted to screw into a conventional light socket for mechanical support and electrical power. The lamp 1 is electrically connected between lamp electrodes 7 and ballast 4, including a starting means, by a plurality of conductors 8. Male screw shell 6 is electrically connected to ballast 4 by a conductor 9, and a second conductor 10 connects ballast 4 to a screw shell center contact 11 at the extreme proximal end of the lamp and ballast supporting structure 12 which is comprised of the foregoing described components.

Figure 2:
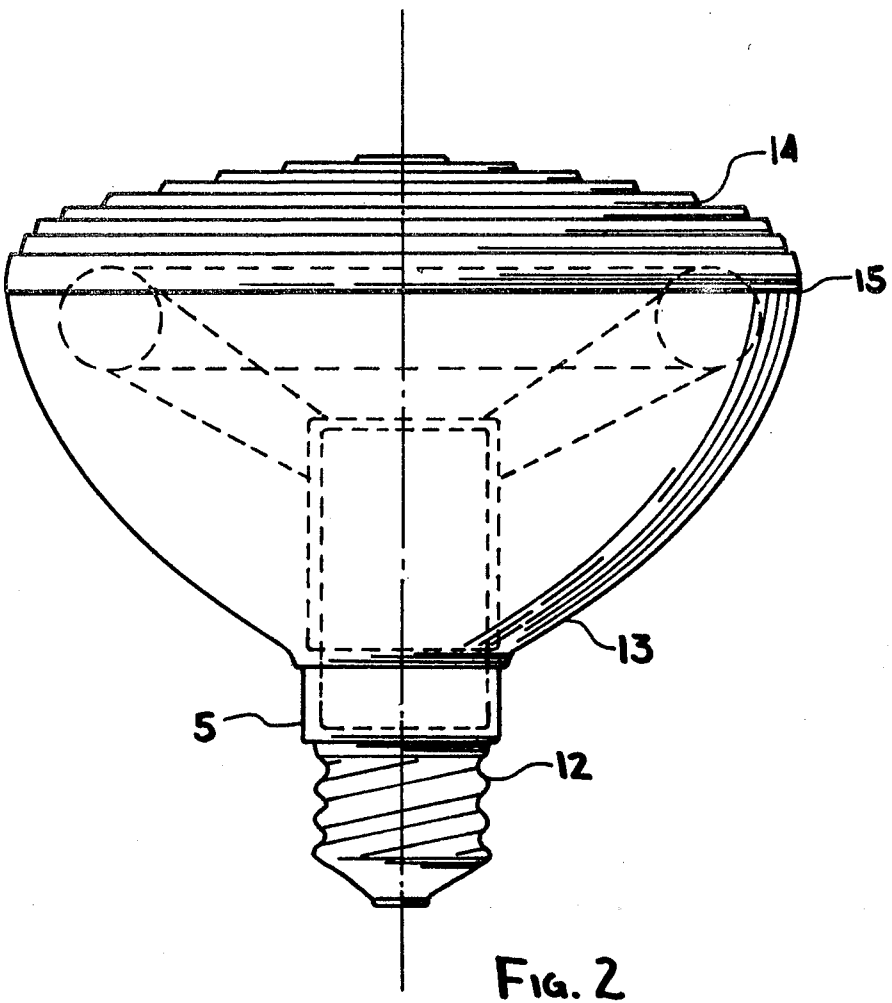
FIG. 2 is a side elevation view of a reflector lamp according to the invention, including the ballast and lamp supporting structure of FIG. 1 shown in phantom.

FIG. 2 shows the lamp and ballast supporting structure 12 disposed within a generally concave reflector 13 supported from tubular extension 5. A transparent lens 14 encloses the lamp in the distal direction and joins reflector 13 in a generally circular sealed joint 15.

Figure 3:
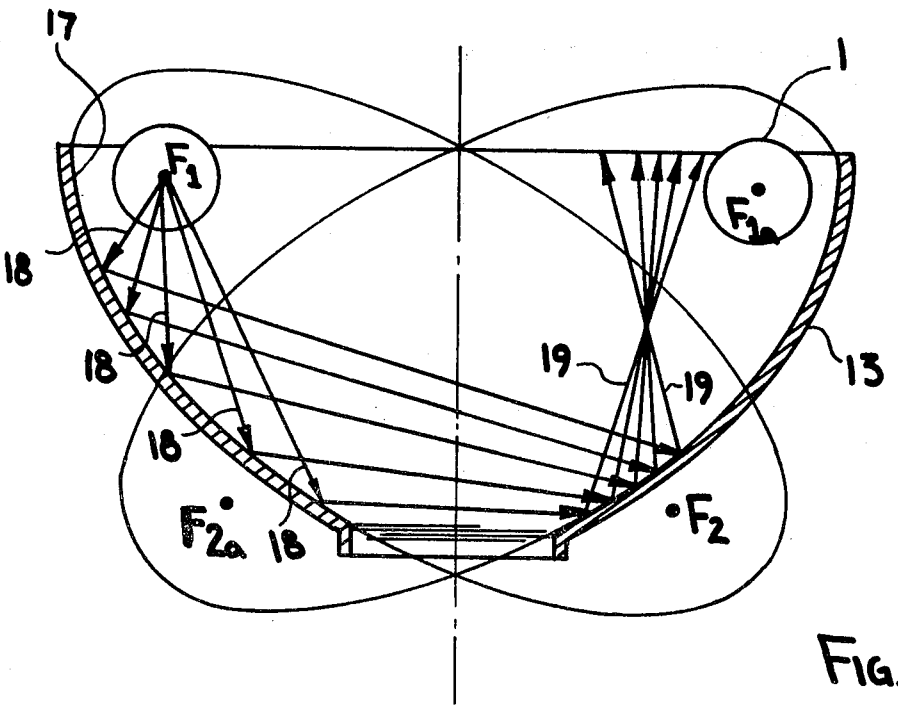
FIG. 3 is a cross-sectional view of the reflector of the lamp of FIG. 2.

FIG. 3 shows reflector 13 in cross-section, partially enclosing lamp 1 in the proximal direction, whereby light emitted from the lamp 1 in the proximal direction is reflected generally into the distal direction. Reflector 13 is shaped as an elipse of revolution wherein an eliptical contour 17 having a first focus $F_1$ and a second conjugate focus $F_2$. Focus $F_1$ is generally at the circular centerline of the lamp cross section, and is rotated in a full circle, passing through point $F_1a$, as the conjugate focus also rotates in a full circle, passing through point $F_2a$; whereby the eliptical contour 17 inscribes an elipse of rotation reflecting proximal rays 18 from lamp 1 into distal rays 19.

Figure 4:
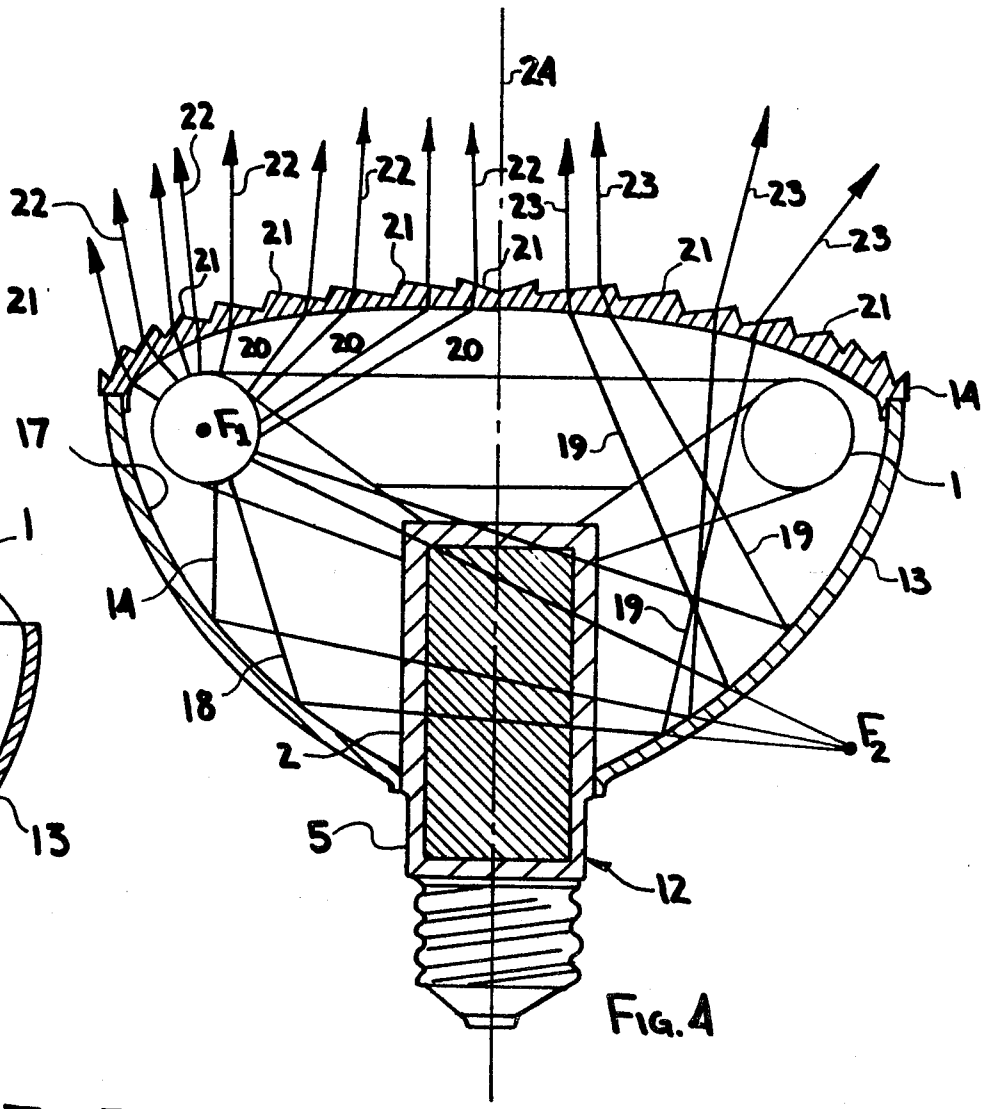
FIG. 4 is a cross-sectional view of the reflector lamp of FIG. 2.

In FIG. 4 lamp and ballast supporting structure 12 is shown disposed within the enclosure formed by reflector 13 and lens 14 wherein lamp 1 emits light in both the proximal and distal directions. Distal rays 2 from lamp 1 pass through lens 14 having prismatic elements 21 of generally positive optical power, whereby distal rays 20 are directed towards the optical axis as rays 22. Proximal rays 18 from lamp 1 which are reflected into distal rays 19 by reflector 13 also pass through the optical elements 21 of lens 14 to emerge as distal rays 23 relatively parallel to the optical axis 24, whereby the emitted light has the general characteristics of a spotlight or a narrow floodlight beam. Since the reflected rays within the lamp must be off axis to miss ballast housing 2, ballast 4 is configured in an elongated shape to minimize the cross-section of ballast housing 2. The elongated ballast 4 partially fills the tubular extension 5 outside the lamp enclosure, permitting direct radiation of the ballast heat to free air outside the lamp enclosure formed by the combination of reflector 13 and lens 14.

I claim:

1. A circular gas discharge reflector lamp comprising:

a ballast housing supporting and at least partially enclosing a current controlling ballast and having proximal and distal ends;

a generally tubular member extending from the proximal end of the ballast housing and terminating in a male screw shell;

a plurality of lamp engaging arms extending from the ballast housing and adapted to retain a circular gas discharge lamp;

a circular gas discharge lamp retained by the lamp engaging arm and disposed coaxially with respect to the male screw shell and distally with respect to the ballast housing, and capable of emitting light, when energized, in the proximal and distal directions;

a plurality of electrical conductors connecting the male screw shell, the lamp and the ballast into an operative circuit to light the lamp with electrical power applied to the male screw shell;

a generally concave reflector partially enclosing the lamp and attached to the ballast housing, so contoured as to receive incident light from the lamp emitted in the proximal direction and to reflect the incident light generally in the distal direction; and a lens attached at its perimeter to the perimeter of the reflector and completing the enclosure of the lamp, so oriented as to transmit incident light from the lamp emitted in the distal direction, and also to transmit incident light reflected in the distal direction by the reflector.

2. A circular gas discharge reflector lamp according to claim 1 in which the reflector has a cross-sectional contour of a partial elipse of rotation, with a first focus along the radius of the circular lamp and a distance to the second conjugate focus sufficiently less than the diameter of the lamp to cause rays emitted from the lamp to be reflected in the distal direction and inside the circle of the lamp.

3. A circular gas discharge reflector lamp according to claim 1 in which the reflector has a cross-sectional contour of a partial elipse of rotation, with a first focus along the radius of the circular lamp and a distance to the second conjugate focus sufficiently less than the diameter of the lamp to cause rays emitted from the lamp at or near the first focus to be directed to the second focus, to strike the reflector diametrally opposite the first focus and be reflected into the distal direction, and to cause rays emitted from the lamp and striking the reflector near the first focus to also be directed to the second focus, to strike the reflector near the second focus and to be reflected into the distal direction.

4. A circular gas discharge reflector lamp according to claim 1 in which the ballast housing, proximal tubular member and the lamp retaining arms are a unitary part molded of a self-extinguishing plastic, and the reflector and lens are made of a different material.

5. A circular gas discharge reflector lamp according to claim 1 in which the lamp terminals are wires, the screw shell conductors are wires, the ballast terminals are wire-wrap pins and the ballast is provided with additional wire-wrap pins, and the wires of the lamp and screw shell are connected into an operative circuit with wire-wrap attachments to the wire-wrap pins of the ballast.

6. A circular gas discharge reflector lamp according to claim 1 in which the screw shell is joined to the tubular extension of the ballast housing, the tubular extension is joined to the ballast housing, the reflector is joined to the ballast housing, and the lens is joined to the reflector, all with continuously sealed joints which form a watertight envelope.

7. A circular gas discharge reflector lamp according to claim 1 in which the lens has generally positive optical power tending to refract incident rays toward the lamp centerline in the distal direction.

8. A circular gas discharge reflector lamp according to claim 1 in which the ballast housing is at least partially ouside the enclosure formed by the reflector and lens, and the ballast housing is capable of transferring heat to the free air outside the lamp.

* * * * *